US005394059A

United States Patent [19]

Ohyama et al.

[11] Patent Number: 5,394,059

[45] Date of Patent: Feb. 28, 1995

[54] METALLIC VAPOR DISCHARGE LAMP AND A METHOD FOR CURING PAINTS AND INKS THEREWITH

[75] Inventors: Masachika Ohyama, Himeji; Tetsuo Fuse, Kurashiki; Motohiro Sakai; Kazuyuki Mori, both of Himeji, all of Japan

[73] Assignee: Oshiodenki Kabushiki Kaisha, Tokyo, Japan

[21] Appl. No.: 978,565

[22] Filed: Nov. 19, 1992

[30] Foreign Application Priority Data

Nov. 21, 1991 [JP] Japan ..... 3-331610

[51] Int. Cl.[6] ..... H01J 61/18; H01J 61/20

[52] U.S. Cl. ..... 313/639; 313/638; 313/641

[58] Field of Search ..... 313/639, 638, 642, 641, 313/562

[56] References Cited

U.S. PATENT DOCUMENTS

| | | | |
|---|---|---|---|
| 4,243,906 | 1/1981 | Wilson . | |
| 4,745,335 | 5/1988 | Ohyama et al. | 313/639 |
| 4,769,576 | 9/1988 | Ohyama et al. | 313/639 |
| 5,107,178 | 4/1992 | Ohyama et al. | 313/638 |

FOREIGN PATENT DOCUMENTS

| | | |
|---|---|---|
| 2270673 | 12/1975 | France . |
| 2393419 | 12/1978 | France . |
| 3632431 | 4/1987 | Germany . |
| 3912223 | 10/1990 | Germany . |
| 52-016886 | 2/1977 | Japan . |
| 54-15503 | 6/1979 | Japan . |
| 54-150873 | 11/1979 | Japan . |
| 58-18743 | 4/1983 | Japan . |
| 62-80959 | 4/1987 | Japan . |
| 1-161655 | 6/1989 | Japan . |
| 1498258 | 1/1978 | United Kingdom . |

OTHER PUBLICATIONS

Patent Astracts of Japan, The Patent Office, Japanese Govt., vol. 13, No. 374 (E-808) [3722], dt. Aug. 18, 1989.

Patent Abstracts of Japan, The Patent Office, Japanese Govt., vol. 13, No. 433 (E-824) [3781] dt. Sep. 27, 1989.

*Primary Examiner*—Donald J. Yusko
*Assistant Examiner*—Vip Patel
*Attorney, Agent, or Firm*—Keck, Mahin & Cate

[57] ABSTRACT

In a metallic vapor discharge lamp, in whose arc tube provided with electrodes are encapsulated together with mercury and inert gas, whose quantity is adequate for maintaining arc discharges, an adequate quantity of iron and an adequate quantity of a metal, in which at least one of the metals tin, magnesium, bismuth, thallium, cadmium or manganese is selected, together with halogen, as a result of the fact that the encapsulated halogen at least contains bromine, whose weight ratio to the total halogen is 0.26%, the adhesion of iron to the inside of the arc tube is prevented and consequently a radiation intensity of the ultraviolet rays effective for curing paints or inks is maintained over a long period of time.

4 Claims, 1 Drawing Sheet

METALLIC VAPOR DISCHARGE LAMP AND A METHOD FOR CURING PAINTS AND INKS THEREWITH

FIELD OF THE INVENTION

The invention relates to a metallic vapor discharge lamp used for photochemical reactions, for curing paints, and inks, as well as for similar purposes.

BACKGROUND OF THE INVENTION

Frequently ultraviolet rays are used for producing photochemical reactions or for curing paints, inks and the like. Ultraviolet rays in a wavelength range of approximately 280 to 400 nm are effective in curing paints, inks and the like.

The radiation source for the ultraviolet rays with such a wavelength range is conventionally constituted by a high pressure mercury vapor lamp. The radiation light of a high pressure mercury vapor lamp consists of a plurality of line spectra, which are in a rather wide wavelength range. However, it is not effective to use a high pressure mercury vapor lamp for photochemical reactions, for curing paints and the like, because the effective wavelength range for such purposes is 280 to 400 nm.

It is therefore becoming ever more frequent practice to use a metallic vapor discharge lamp, in which in an arc tube of a high pressure mercury vapor lamp together with the mercury use is made of another metal, i.e. a metal iodide, metal bromide, metal chloride or metal halide comprising a composition of said metals, encapsulated as light-emitting materials and in this way the radiant quantity of the effective wavelength range is increased. In particular, a metallic vapor discharge lamp in which iron is encapsulated together with the mercury is favorable for photochemical reactions or curing paints and the like due to its continuous radiation spectrum in a wavelength range of 350 to 400 nm. However, if a metallic vapor discharge lamp in which iron is encapsulated remains in operation for a long time, a thin film is formed due to the adhesion of the iron to the inner wall of the arc tube.

More particularly in order to increase the productivity in a drying process for paints, inks or the like, it is desirable to have a metallic vapor discharge lamp, which emits stronger, effective ultraviolet rays.

However, if in order to meet this need, a larger amount of iron is encapsulated, within a relatively short time a thin iron film is formed in an even greater quantity on the inner wall of the arc tube. It is therefore considered disadvantageous that the thin iron film formed on the inner wall of the arc tube prevents the permeability of the effective ultraviolet rays through the arc tube wall and consequently the intensity of the ultraviolet rays in the wavelength range of 280 to 400 nm is reduced because of the formation of a thin iron film after a lighting period of a few dozen hours. To eliminate the aforementioned deficiency, a metallic vapor discharge lamp is proposed in which, together with the mercury, iron and also a further metal are encapsulated, so that no thin iron film is formed. As is known, the formation of a thin iron film on the inner wall of an arc tube can be prevented if an addition is made of e.g. lead (Japanese Utility Model SHO 54-15503), tin (Japanese Patent SHO 58-18743), magnesium (Japanese Published Patent Application SHO 62-80959), cadmium (Japanese Published Patent Application HEI 1-161655), manganese (Japanese Published Patent Application HEI 1-128345) or the like.

However, of late there has been a considerable need for a lamp, which has a strong radiation in the wavelength range 280 to 400 nm, whilst at the same time having a longer life. However, if the aforementioned metals are added to a lamp, it has been found that a thin iron film is still formed on the inner wall of the arc tube if the lighting period is extended. This means that the addition of the aforementioned metals to a lamp, in which mercury and iron are encapsulated, cannot completely effectively prevent the formation of a thin iron film and instead only reduces the speed with which such a film is formed.

The above-described lamps are conventionally used in such a way that the outside of the arc tube is cooled to approximately 850° C. with cooling air within a lamp housing. It has been found that the formation of a thin iron film can be significantly reduced if the maximum temperature of the outside of the arc tube of the metallic vapor discharge lamp is kept at approximately 800° C., by increasing such a cooling action. By reducing the maximum temperature of the outside of the arc tube to approximately 800° C., there is also a reduction in the temperature of the coolest portion of the inside of the arc tube, which reduces the intensity of the emission through the luminescing of the iron and consequently also reduces the radiation intensity of the ultraviolet rays used for curing paints and the like even though there is no formation of a thin iron film.

SUMMARY OF THE INVENTION

The object of the invention is consequently to prevent the adhesion of iron to the inner wall of the arc tube and to provide a metallic vapor discharge lamp, which has a high radiation intensity of the ultraviolet rays in the wavelength range of 280 to 400 nm over a long period of time.

According to the invention this object is achieved in that in a metallic vapor discharge lamp and specifically within its arc tube, which is provided with electrodes, together with mercury and inert gas, whose quantity is adequate for maintaining the arc discharges, a suitable quantity of iron and a suitable quantity of a metal, whilst choosing at least one of the metals tin, magnesium, bismuth, thallium, cadmium or manganese, as well as halogen are encapsulated and that the halogen at least contains bromine in such a way that the bromine content relative to the total halogen quantity is in a weight ratio of equal to or higher than 0.26%.

As a result of the measure by which the bromine content relative to the total halogen quantity is in a weight ratio of equal to or higher than 0.26%, there is scarcely any reduction in the radiation intensity through the luminescing of iron, even if the maximum temperature of the outer wall of the arc tube is reduced to approximately 800° C. and consequently there is also scarcely no reduction in the ultraviolet radiation intensity effective for curing, which sufficiently permits the use of such a metallic vapor discharge lamp for curing purposes.

A further advantage is that as a result of the measure by which lighting takes place with a reduced maximum temperature of the inner wall of the arc tube, the formation of a thin film caused by adhesion of the iron to the inner wall of the arc tube is prevented and consequently the ultraviolet radiation intensity can be maintained over a long period.

If the weight ratio of the bromine content to the total halogen quantity is below 0.26%, in the case of lighting with a maximum temperature of approximately 800° C. of the outer wall of the arc tube, there will be no effective increase in the radiation intensity in the wavelength range 280 to 400 nm, because there is a significant reduction in the ultraviolet radiation intensity.

BRIEF DESCRIPTION OF THE DRAWINGS

An embodiment of the invention is described in greater detail hereinafter relative to the drawings, wherein show.

DETAILED DESCRIPTION

Figure 1:
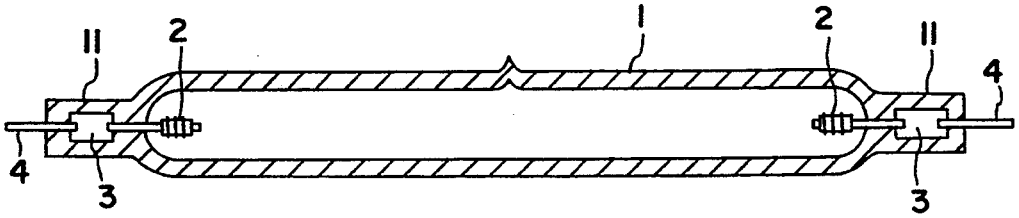
FIG. 1 A diagrammatic representation of a metallic vapor discharge lamp.

FIG. 1 shows a metallic vapor discharge lamp having a rated power of 24 KW, which is used as a light source for industrial applications using photochemical reactions, such as curing of paints and the like.

Reference numeral 1 designates an arc tube with an internal diameter of 22 mm, which comprises a quartz glass tube and in which two electrodes 2, 2 face one another with a spacing of 1450 mm. At both ends of the arc tube 1 is in each case provided a seal portion 11, in which is hermetically enclosed a molybdenum foil 3. A lead wire 4 and the electrode 2 are connected by means of the molybdenum foil 3. Within the arc tube 1 are encapsulated 700 mg of metallic mercury, 5.8 mg of iron, 5 mg of HgBr 30 mg of $HgI_2$, 27 mg of $BiI_3$ and 50 mmHg of xenon gas. In this embodiment the mixing weight ratio of bromine to the total halogen is 6.10%.

If the lighting operation of the metallic vapor discharge lamp is performed with the above-described arrangement and with cooling air in a lamp housing, so that the maximum temperature of the arc tube is 800° C., ultraviolet rays are effectively emitted in the wavelength range of approximately 280 to 400 nm necessary for curing.

The intensity of the ultraviolet rays in the wavelength range 280 to 400 nm is, as will be explained hereinafter relative to table 1, is as high as in the operation of a conventional metallic vapor dicharge lamp, to which no bromine is added and in which the maximum temperature of the outside of the arc tube is kept at 850° C.

In addition, the intensity of the ultraviolet rays in the case of the lighting operation of a conventional metallic vapor discharge lamp, to which no bromine has been added, with a constant maximum temperature of the outside of the arc tube of 800° C., is approximately 70% of the intensity of lighting operation at 850° C. Thus, the radiation intensity of the ultraviolet rays in the lamp wavelength range of 280 to 400 nm, in which the mixing ratio of the bromine to the total halogen quantity is 6.10% by weight, is 43% higher than the radiation intensity of the ultraviolet rays of the conventional lamp to which no bromine has been added, if the two lamps are operated under the same conditions, so that the temperature of the outside of the arc tube is kept at 800° C.

It has been found that the lighting operation of the lamp in this embodiment can be performed at 800° C., in order to obtain the same radiation intensity of the ultraviolet rays as in the lighting operation of the conventional lamp with the constant maximum temperature of the outside of the arc tube of 850° C. Thus, the operation of the lamp according to the invention is possible with a lower tube wall temperature than in a conventional lamp. Therefore in the case of the lamp according to the invention, the formation of a thin iron film on the inner wall of the arc tube is more effectively prevented than in a conventional lamp.

Figure 2:
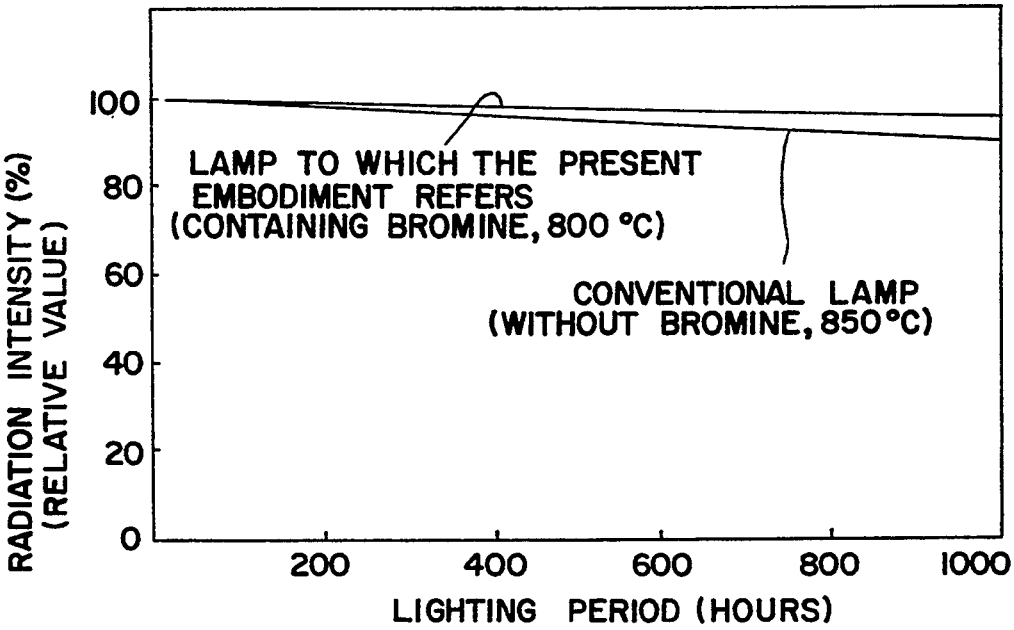
FIG. 2 A diagrammatic representation showing how the radiation intensity of the ultraviolet rays is maintained in the wavelength range 280 to 400 nm.

Thus, as shown in FIG. 2, the radiation intensity in the wavelength range of 280 to 400 nm of the lamp in the case of the embodiment according to the invention in the case of a lighting period of 1000 hours is maintained equal to or greater than 95%, whereas in the case of the radiation intensity of the ultraviolet rays in the wavelength range 280 to 400 nm of the conventional lamp, to which no bromine is added and with a lighting period of 1000 hours it is maintained at approximately 90%. The reason is that in the conventional lamp the lighting operation takes place with a maximum temperature of the outside of the arc tube of 850° C. in order to obtain the same ultraviolet radiation intensity and it is consequently easy for a thin iron film to form on the inside of the arc tube.

Table 1 shows the measurement result of the relation between the mixing ratio of bromine (% by weight) to the total halogen quantity and the radiation intensity of the ultraviolet rays (relative values) in the case of a lighting operation with a maximum temperature of the outside of the arc tube of 800° C. The mixing ratios between the iodine and the bromine are changed by modifying the quantities of encapsulated $HgBr_2$ and $HgI_2$. For comparison purposes, table 1 also gives details over the abovedescribed conventional lamp and its lighting conditions.

TABLE 1

| | Conventional lamp | | Lamp for examination | | | | | | |
|---|---|---|---|---|---|---|---|---|---|
| Encapsulated halogen | iodine | | iodine and bromine | | | | | | |
| Max.temperature of outside of arc tube | 850° C. | 800° C. | 800° C. | | | | | | |
| Bromine mixing ratio | 0 | 0 | 0,13 | 0,26 | 0,65 | 1,28 | 2,53 | 6,10 | 11,5 |
| Wavelength 350 to 400 nm | 97 | 40 | 50 | 93 | 96 | 97 | 98 | 100 | 100 |
| Wavelength 280 to 400 nm | 100 | 70 | 83 | 95 | 98 | 100 | 100 | 100 | 100 |

In table 1 the wavelength range 350 to 400 nm is a range in which it is particularly clearly possible to show continuous spectra due to the luminescing of iron and the wavelength range 280 to 400 nm is a range which, as described hereinbefore, is effective for curing purposes. As in both wavelength ranges the radiation intensity of the ultraviolet rays becomes increasingly saturated in proportion to the increase in the mixing ratio of bromine to total halogen, the radiation intensity at which the bromine mixing ratio is 11.5% is set at 100 and relative values have been represented.

The relative values of the radiation intensity of the ultraviolet rays in the case of the lighting operation of a conventional metallic vapor discharge lamp, in which the bromine mixing ratio is 0% and with a constant maximum temperature of the outside of the arc tube of 850° C., are 97 in the wavelength range 350 to 400 nm and 100 in the wavelength range 280 to 400 nm, as described above.

Thus, as illustrated in table 1, on operating the lamp according to the invention with a mixing ratio of bromine to total halogen quantity of equal to or greater than 1.28% and with a constant maximum temperature of the outside of the arc tube of 800° C. in both radiation ranges precisely as much radiation intensity of the ultraviolet rays is obtained as in the lighting operation of a conventional metallic vapor discharge lamp with a maximum temperature of the outside of the arc tube of 850° C.

The lamp according to the invention is adequately usable if the bromine mixing ratio is 0.26%, because the radiation intensity of the ultraviolet rays decrease by a maximum of approximately 5% compared with the lighting operation of the conventional metallic vapor discharge lamp with a maximum temperature of the outside of the arc tube of 850° C. However, if the bromine mixing ratio is 0.13%, in a lighting operation with a constant maximum temperature of the outside of the arc tube of 800° C., the lamp is not usable due to a considerable reduction of the radiation intensity of the ultraviolet rays. Thus, the mixing ratio of the bromine to the total halogen quantity must be equal to or greater than 0.26% by weight, in order to obtain an adequate radiation intensity of the ultraviolet rays, even when the lighting operation is performed with a constant maximum temperature of the outside of the arc tube of 800° C.

In the case of the lamp to which the present embodiment refers, bismuth was used as the encapsulated metal.

In the case of using tin, magnesium, thallium, cadmium and/or manganese, the same tendency was obtained. This confirms the effectiveness of the measure of using bromine as halogen in a weight ratio to the total halogen quantity of equal to or greater than 0.26%.

EFFECT OF THE INVENTION

In the case of the metallic vapor discharge lamp according to the invention it is possible, as explained hereinbefore, by using a halogen, which at least contains bromine in a weight ratio to the total halogen quantity of equal to or greater than 0.26%, to obtain an adequate radiation intensity of the ultraviolet rays, even if the maximum temperature of the outside of the arc tube is reduced and the formation of a thin iron film on the inside of the arc tube is prevented. Thus, the invention provides a metallic vapor discharge lamp having an effective radiation intensity of the ultraviolet rays for curing paints, inks, etc. over a long period of time.

It is to be understood that although a preferred embodiment of the invention has been described, various other embodiment and variations may occur to those skilled in the art. Any such other embodiments and variations which fall within the scope and spirit of the present invention are intended to be covered by the following claim.

What we claim is:

1. A metal vapor discharge lamp comprising an arc tube in which mercury, iron, at least one halogen and rare gas are sealed, wherein the sealed arc tube further contains at least one metal selected from a group consisting of tin (Sn), magnesium (Mg), bismuth (Bi), thallium (Tl), cadmium (Cd) and manganese (Mn), and the at least one halogen comprises bromine (Br) in an amount of at least 0.26 percent by weight of the total at least one halogen.

2. A method for curing paints and inks comprising radiating said paints and inks with discharge from a metal vapor discharge lamp comprising an arc tube in which mercury, iron at least one halogen and rare gas are sealed, wherein the sealed arc tube further contains at least one metal selected from a group consisting of tin (Sn), magnesium (Mg), bismuth (bi), thallium (Tl), cadmium (Cd) and manganese (Mn), and the at least one halogen comprises bromine (Br) in an amount of at least 0.26 percent by weight of the total at least one halogen.

3. A method according to claim 2 wherein radiation from the arc tube is in the wavelength range of 280 to 400 nm.

4. A method according to claim 2 wherein a maximum temperature on the outside of the arc tube is 800° C.

* * * * *